US011201390B2

(12) United States Patent
Chen et al.

(10) Patent No.: US 11,201,390 B2
(45) Date of Patent: Dec. 14, 2021

(54) ANTENNA STRUCTURE FOR OPTIMIZING ISOLATION OF SIGNAL AND ELECTRONIC DEVICE USING SAME

(71) Applicant: Shenzhen Next Generation Communications Limited, Shenzhen (CN)

(72) Inventors: Kuo-Cheng Chen, New Taipei (TW); Jian-Wei Chang, New Taipei (TW); Yi-Ming Chen, New Taipei (TW); Zheng Lin, Shenzhen (CN); Chih-Chung Hsieh, New Taipei (TW); Ke-Jia Lin, Shenzhen (CN)

(73) Assignee: Mobile Drive Netherlands B.V., Amsterdam (NL)

( * ) Notice: Subject to any disclaimer, the term of this patent is extended or adjusted under 35 U.S.C. 154(b) by 125 days.

(21) Appl. No.: 16/523,511

(22) Filed: Jul. 26, 2019

(65) Prior Publication Data

US 2020/0036105 A1 Jan. 30, 2020

Related U.S. Application Data

(60) Provisional application No. 62/703,891, filed on Jul. 27, 2018.

(51) Int. Cl.
*H01Q 1/32* (2006.01)
*H01Q 21/00* (2006.01)
(Continued)

(52) U.S. Cl.
CPC ..... *H01Q 1/3233* (2013.01); *H01Q 1/38* (2013.01); *H01Q 1/48* (2013.01);
(Continued)

(58) Field of Classification Search
None
See application file for complete search history.

(56) References Cited

U.S. PATENT DOCUMENTS 6,081,237 A * 6/2000 Sato ..... B60R 1/12 343/700 MS
2014/0203960 A1* 7/2014 Huang ..... H01P 5/12 342/175

(Continued)

FOREIGN PATENT DOCUMENTS

CN 106505312 A 3/2017
CN 107611577 A 1/2018

(Continued)

OTHER PUBLICATIONS

Lei Duan, Research on 77GHz Microstrip Array Antenna,Dissertation for the Master's Degree in Engineering, Feb. 15, 2017, pp. 8-60.

*Primary Examiner* — Crystal L Hammond
(74) *Attorney, Agent, or Firm* — ScienBiziP, P.C.

(57) ABSTRACT

An antenna structure serving as an emitter in a radar device with optimized isolation of signal comprises antenna array as the radiating element. The antenna array includes array units. Each array unit includes radiating units connected by a feeder. Radiation area of each radiating unit gradually decreases from a center of array unit to ends of array unit. A specified distance is defined between centers of adjacent radiating units along an extending direction of the feeder. The feeder transmits a current signal to the array units, the radiating unit emits a radar scanning beam based on the current signal.

19 Claims, 10 Drawing Sheets

(51) Int. Cl.
*H01Q 1/48* (2006.01)
*H01Q 1/38* (2006.01)
*H01Q 21/06* (2006.01)

(52) U.S. Cl.
CPC ..... *H01Q 21/0006* (2013.01); *H01Q 21/0075* (2013.01); *H01Q 21/061* (2013.01)

(56) References Cited

U.S. PATENT DOCUMENTS

2016/0141754 A1* 5/2016 Leyh ..... H01Q 13/00
342/372
2018/0253002 A1* 9/2018 Shi ..... G03F 7/16
2018/0309198 A1* 10/2018 Yu ..... H01Q 13/085

FOREIGN PATENT DOCUMENTS

CN 108196255 * 6/2018
CN 108196255 A 6/2018

* cited by examiner

ANTENNA STRUCTURE FOR OPTIMIZING ISOLATION OF SIGNAL AND ELECTRONIC DEVICE USING SAME

FIELD

The subject matter herein generally relates to radar.

BACKGROUND

77 GHz wave frequency is a main frequency in radar. An antenna array in the radar must spatially scan in a specified azimuth, and a tighter antenna array is needed for achieving a wider scanning angle. The tighter antenna array may cause interference, and increase the isolation of the signal of the antenna array. Optimization of the antenna structure may be improved.

BRIEF DESCRIPTION OF THE FIGURES

Implementations of the present disclosure will be described, by way of example only, with reference to the figures.

DETAILED DESCRIPTION

Figure 1:
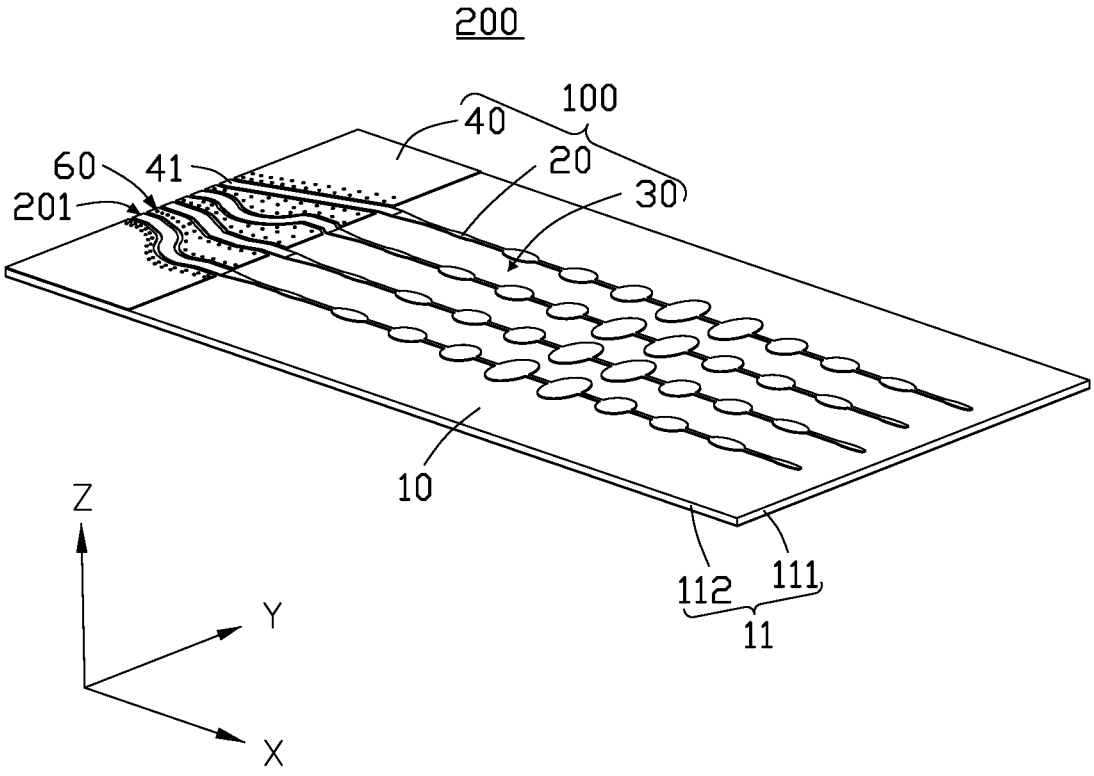
FIG. 1 is a diagram illustrating a first embodiment of an antenna structure in an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

The present disclosure describes an electronic device with an antenna structure for optimizing isolation of signal.

First Embodiment

Figure 2:
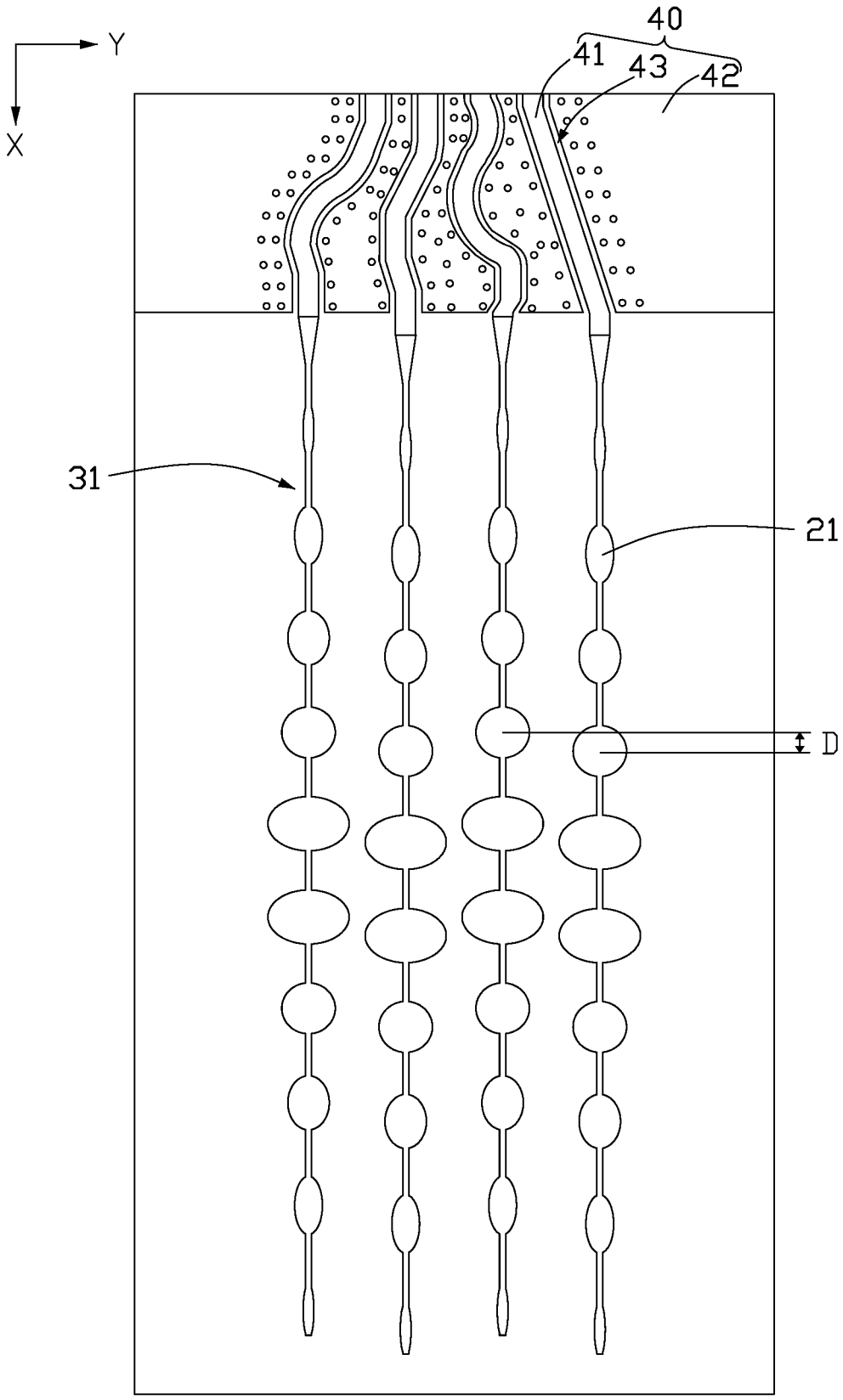
FIG. 2 is a planar view of the antenna structure of FIG. 1.

FIG. 1 shows a first embodiment of an antenna structure 100 in the electronic device 200. FIG. 2 shows the electronic device 200 in a planar view. The antenna structure 100 emits and receives radio waves. The electronic device 200 can be a detection apparatus, such as a radar. The antenna structure 100 is a millimeter-wave radar antenna. The electronic device 200 includes a dielectric slab 10. The electronic device 200 further includes other specified functional mechanical structures, electronic elements, modules, and software (not shown).

The dielectric slab 10 is a printed circuit board. The dielectric slab 10 is made of dielectric material, such as FR4 glass-reinforced epoxy laminate material.

Figure 3:
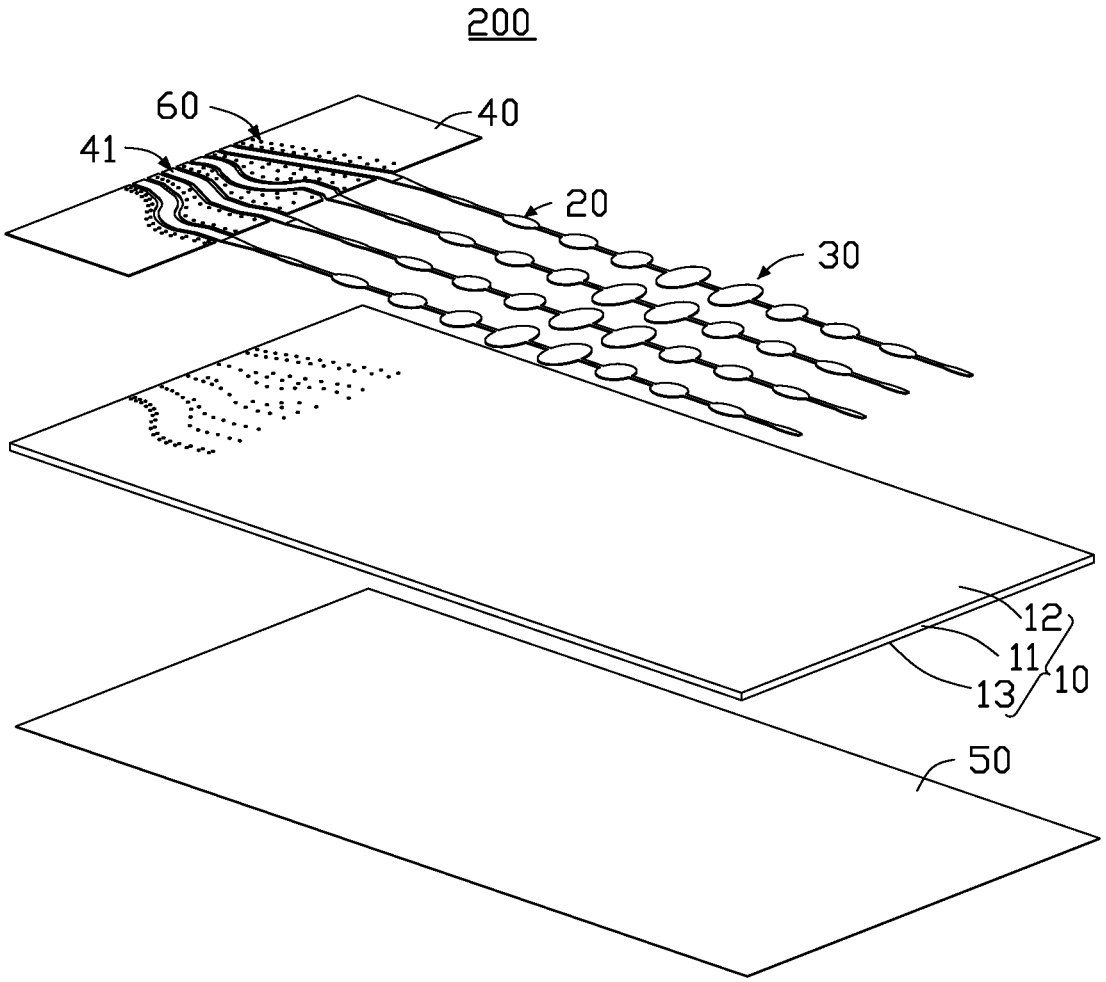
FIG. 3 is an exploded view of the antenna structure of FIG. 1.

Referring to FIGS. 2 and 3, the dielectric slab 10 includes a side wall 11, a first surface 12, and a second surface 13 opposite to the first surface 12. The side wall 11 connects the first surface 12 and the second surface 13. The side wall 11 includes two opposite first walls 111 and two opposite second walls 112. The dielectric slab 10 supports the antenna structure 100. The antenna structure 100 further includes an antenna array 30 and a co-planar waveguide 40.

In one embodiment, the dielectric slab 10 is a substantially rectangular shape. A width of the dielectric slab 10 is parallel with a Y axis, and a length of the dielectric slab 10 is parallel with an X axis. The first wall 111 is extended along the Y axis, and the second wall 112 is extended along the X axis. A bottom wall is one of the first walls 111 away from an origin, and a top wall is the other of the first walls 111 adjacent to the origin.

In one embodiment, the antenna array 30 includes n array units 20 parallel with each other. The n array units 20 form the antenna array 30, where n is an integer larger than 1.

In one embodiment, each array unit 20 includes N radiating units 21, where N is an integer larger than 1. In one embodiment, as shown in FIG. 2, N is 10. Each array unit 20 includes ten radiating units 21. In other embodiments, N is adjustable. The N radiating units 21 are connected with each other by a feeder 41 to form the array unit 20. The feeder 41 transmits a current signal to the array unit 20, and the radiating unit 21 emits a radar beam based on the current signal. The N radiating units 21 are arranged along a first direction, such as an X axis direction. A length of the radiating unit 21 is parallel with the X axis, and a width of the radiating unit 21 is parallel with a Y axis. The feeder 41 is extended along the X axis, and the Y axis is perpendicular to the extending direction of the feeder 41. Each radiating unit 21 is substantially an ellipse shape. The length of each radiating unit 21 is different from its width. In other embodiments, the radiating unit 21 can be other shapes, such as rectangular or triangular.

In one embodiment, the radiating area of each radiating unit 21 is different. The radiating areas of the radiating units 21, connected in series by one feeder 41, gradually decrease from a center of the array unit 20 to ends of the array unit 20. A maximum radiating area is found on two radiating units 21 which are in the middle of the array unit 20. The radiating area of others radiating units 21, adjacent to the first wall 111, gradually decreases, and is maximum at most proximate to the first wall 111. Length to width ratio of other radiating units 21 away from the first wall 111 gradually decreases, and is minimum in the middle of the array unit 20. The length to width ratio of the radiating unit 21 is proportional to an impedance of the radiating unit 21, and the impedance of the radiating unit 21 is inversely proportionate to a radiating power of the radiating unit 21. Thus, a maximum radiating power is found in the two radiating units 21 in the middle of the array unit 20, and a minimum radiating power is found in the two radiating units 21 adjacent to the first wall 111. Thereby, a side-lobe level of the radiating structure 100 is reduced.

FIG. 2 shows the array units 20 in a planar view. A distance between adjacent radiating units 21 is 0.5λ. λ represents a wavelength of a current signal transmitted in the feeder 41 of the antenna structure 100. In one embodiment, the λ is a stable value.

The n array units 20 are arranged along a second direction, such as the Y axis direction. In one embodiment, a distance between adjacent array units 20 is in a range from 0.5λ1 to 0.75λ1 λ1 represents a wavelength of a current signal from the antenna structure 100 being broadcast. In one embodiment, the λ1 is a stable value.

In one embodiment, a specified distance D is defined between centers of the radiating units 21 in two adjacent series 20 along the extending direction of the feeder 41. The centers of the radiating units 21 in two adjacent series 20 are staggered arranged along the Y axis. For example, the centers of the Mth radiating units 21 in every two adjacent array units 20 from a same end are staggered along the Y axis. M is an integer larger than 1. The specified distance D is in a range from 0.4 millimeters (mm) to 0.55 mm.

In one embodiment, as shown in FIG. 2, n is 4. The antenna array 30 includes four array units 20. In other embodiments, n can be other value larger than 1.

In one embodiment, the co-planar waveguide 40 is a substantially rectangular shape. The co-planar waveguide 40 includes n feeders 41, a ground layer 42, and a plurality of slots 43. The number of feeders 41 is same as the number of array units 20. Each side of the feeder 41 defines one slot 43. The slot 43 separates the feeder 41 from the ground layer 42. The feeders 41, the slots 43, and the ground layer 42 are coplanar with each other. The feeders 41 and the ground layer 42 are made of metal material.

In one embodiment, an end of the feeder 41 is electrically connected with the array unit 20, and another end of the feeder 41 is electrically connected to a feeding portion 201 (e.g., FIG. 1) of the electronic device 200. By the feeder 41, the feeding portion 201 transmits a current signal to each radiating unit 21. A length of each feeder 41 is the same. A length of the feeder 41 from the feeding portion 201 to the Mth radiating unit 21 is the same. The current signal is provided to all of the array units 20, thus the antenna structure 100 emits a radar beam.

Referring to FIG. 3, the antenna structure 100 further includes a grounding surface 50. The ground surface 50 provides a ground voltage level. In one embodiment, the antenna array 30 and the co-planar waveguide 40 are disposed in the first surface 12. The co-planar waveguide 40 is not coplanar with, but is parallel to, the grounding surface 50. The radiating unit 21 is made of metal material, such as copper. The feeder 41 is a microstrip line.

In one embodiment, the grounding surface 50 is made of metal material, such as copper. The shape of the grounding surface 50 is same as the shape of the dielectric slab 10. The grounding surface 50 is substantially a rectangular shape. A width of the grounding surface 50 is equal to the width of the dielectric slab 10, and a length of the grounding surface 50 is equal to the length of the dielectric slab 10. In other embodiments, the shapes of the grounding surface 50 and the dielectric slab 10 are adjustable, and not to be limited to the examples provided herein.

In one embodiment, the antenna structure 100 further defines a plurality of through holes 60. The through holes 60 surround the feeders 41 and the slots 43. The through holes 60 pass through the dielectric slab 10 for connecting the grounding layer 42 and the grounding surface 50, thus the antenna array 30 is grounded.

Figure 4:
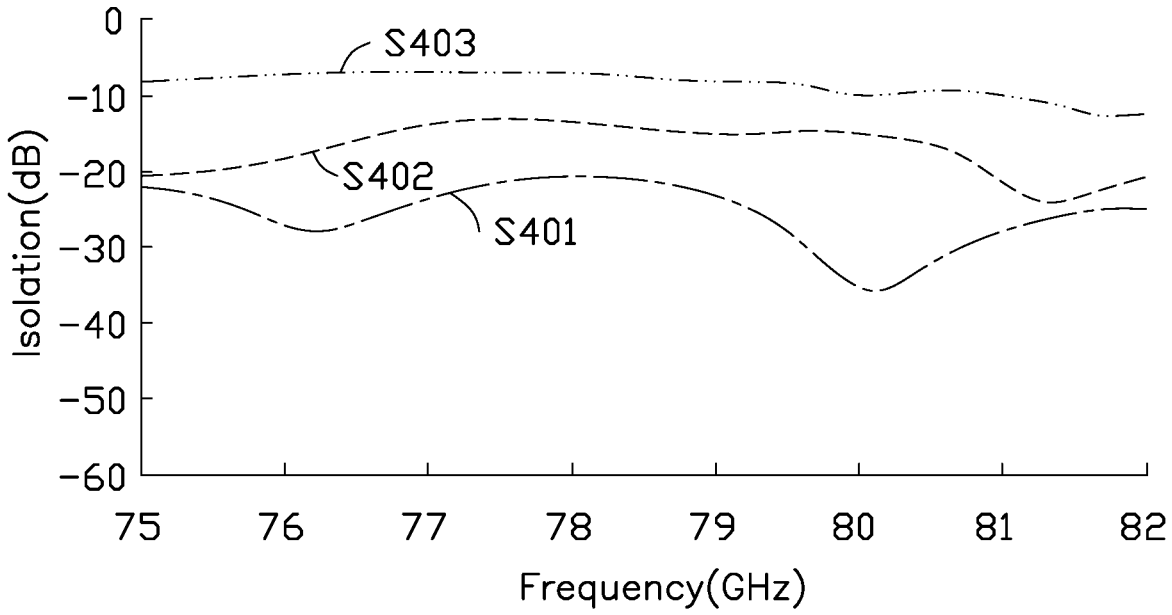
FIG. 4 shows waveform isolations of the antenna structure of FIG. 3.

FIG. 4 shows isolation curves of the array units 20 in the antenna structure 100. A curve S401 represents an isolation between the radiating units 21, in adjacent array units 20, with the staggered centers of the radiating units 21 arranged along the Y axis, which have different areas. A curve S402 represents an isolation between the radiating units 21, in the array units 20, with the centers of the radiating units 21 arranged in a line along the Y axis, which have different areas. A curve S403 represents an isolation between the radiating units 21, in the array units 20, with the centers of the radiating units 21 arranged in a line along the Y axis, which have same areas. Based on the staggered centers of the radiating units 21 and the different areas of the radiating units 21, the isolation of the antenna structure 100 is improved.

Figure 5:
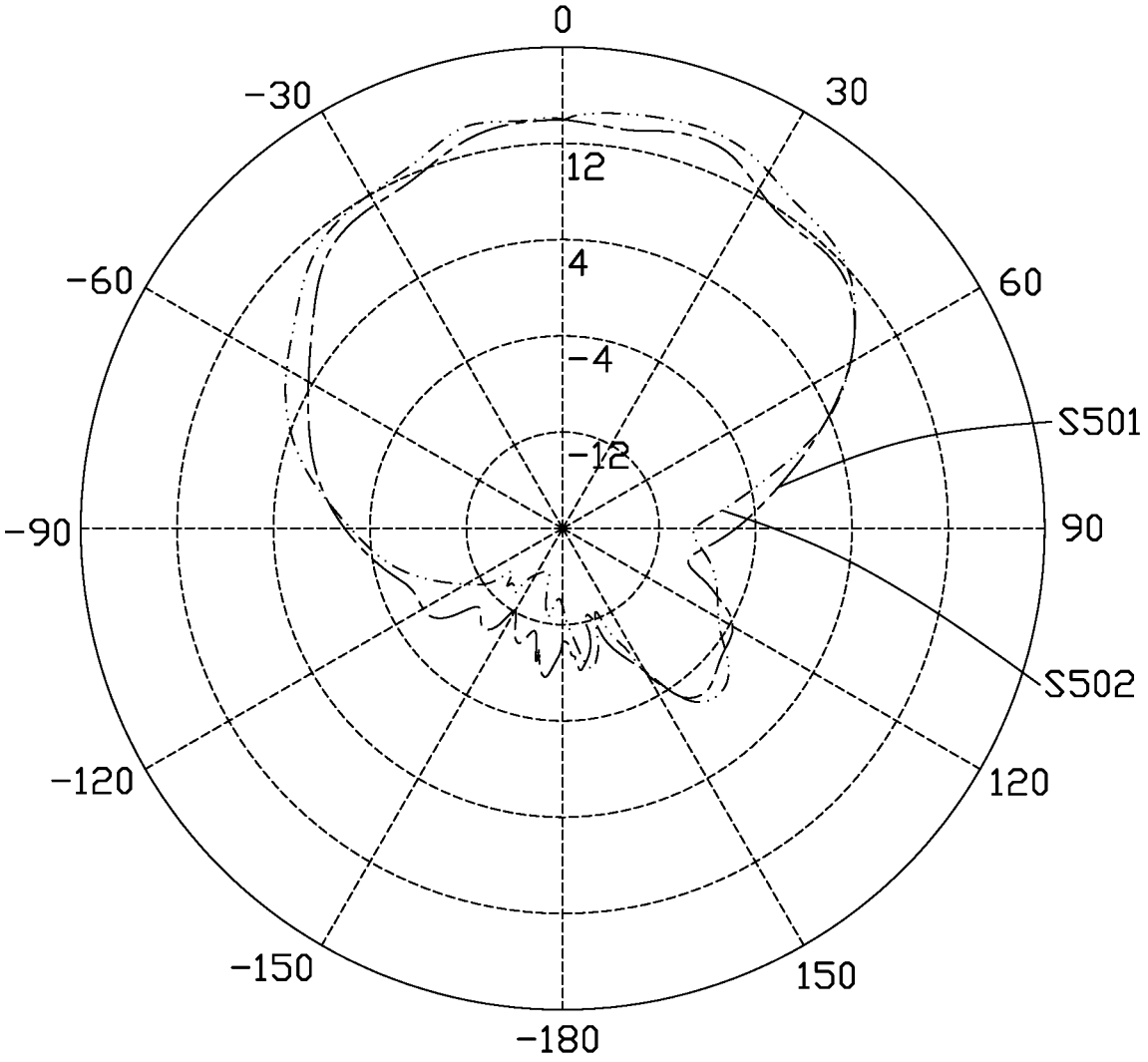
FIG. 5 shows radiation patterns of the antenna structure of FIG. 3.

FIG. 5 shows radiation patterns of the antenna structure 100 at different directions, which represents the gain of the antenna structure 100. The unit of the gain is dB. A curve S501 represents a radiation pattern of the n array units 20 with the staggered centers of the radiating units 21 arranged along the Y axis. A curve S502 represents a radiation pattern of the n array units 20 with the centers of the radiating units 21 in a line arranged along the Y axis. As shown, the gain of the antenna structure 100 having the array unit 20 with the centers of the radiating units 21 in a line arranged along the Y axis is similar to the gain of the antenna structure 100 having the array unit 20 with the centers of the radiating units 21 in a line along the Y axis.

Figure 6:
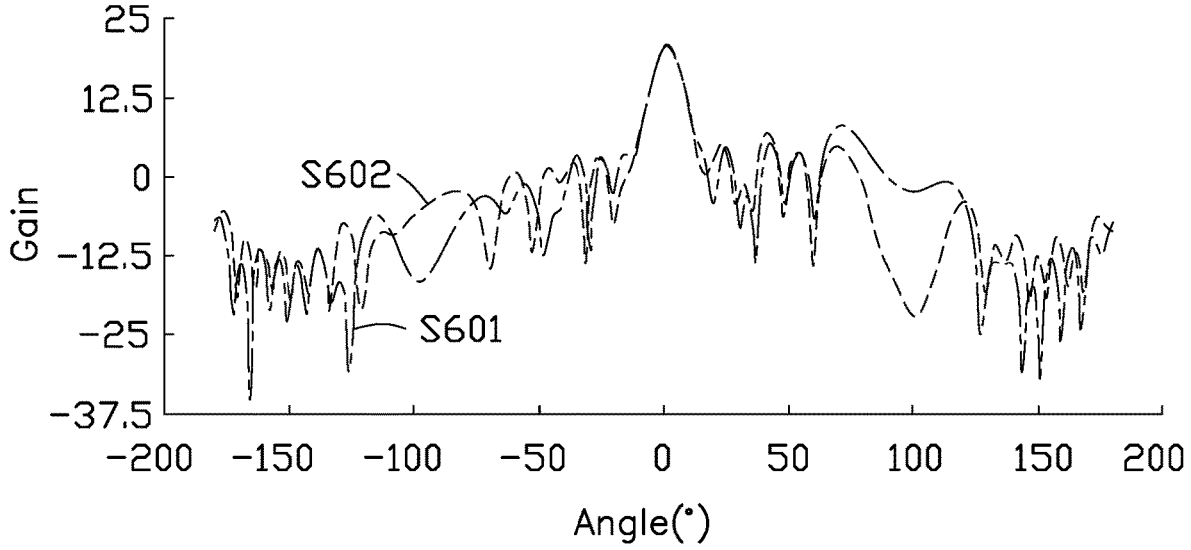
FIG. 6 shows waveform gain maps of the antenna structure of FIG. 3.

FIG. 6 shows waveform gain maps of the antenna structure 100 at different angles of a circle. A curve S601 represents the gain map of the n array units 20 with the staggered centers of the radiating units 21 arranged along the Y axis. A curve S602 represents the gain map of the n array units 20 with the centers of the radiating units 21 arranged in a line along the Y axis. As shown, the gain of the antenna structure 100 having the array unit 20 with the centers of the radiating units 21 in a line arranged along the Y axis is similar to the gain of the antenna structure 100 having the array unit 20 with the centers of the radiating units 21 in a line along the Y axis.

Figure 7:
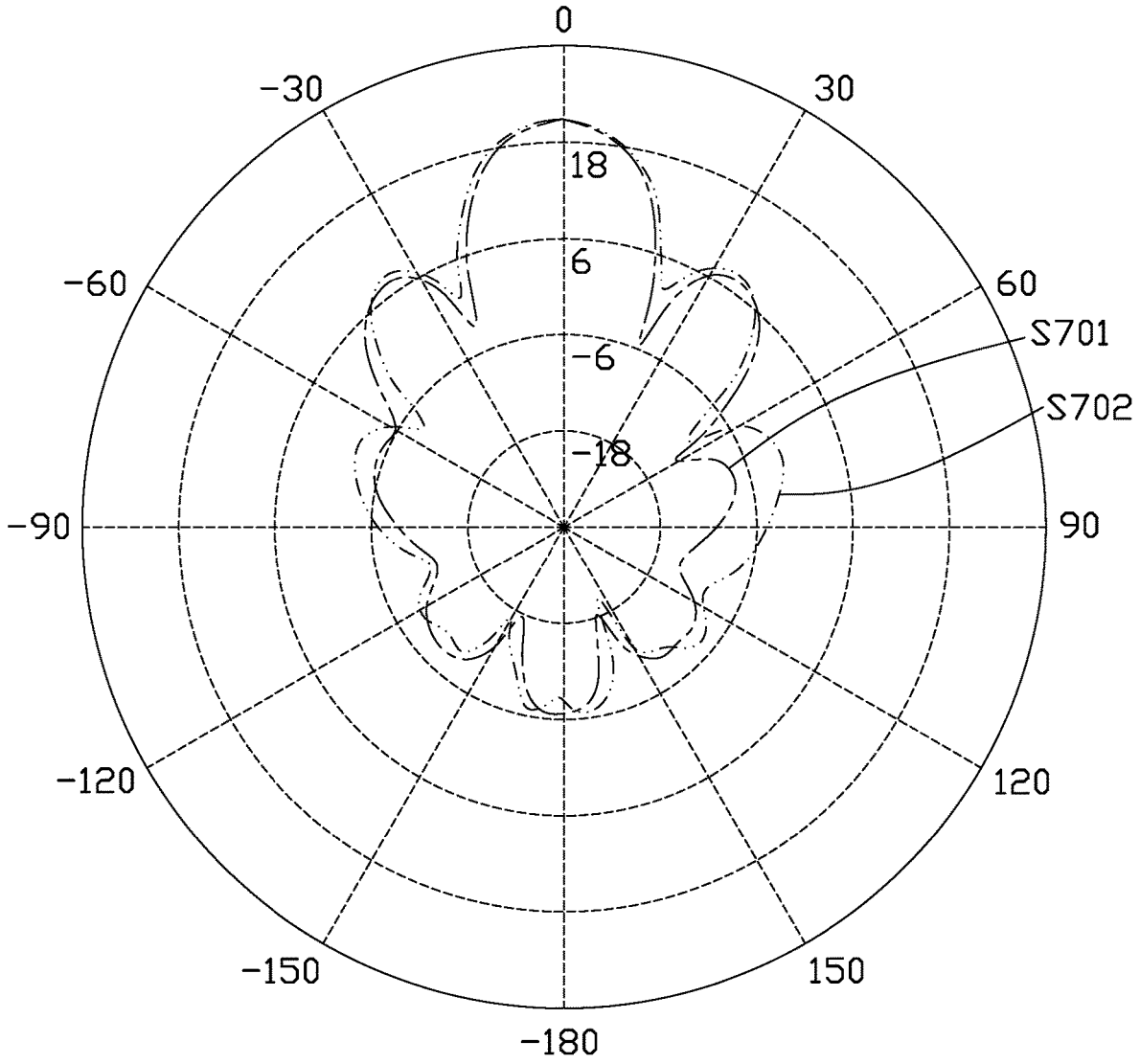
FIG. 7 shows waveform radiation patterns of the antenna structure of FIG. 3 at a zero degree direction.

FIG. 7 shows the radiation patterns of the antenna structure 100 at zero degree direction, that is the starting point of a circular traverse. The zero degrees is a main radiation direction of the antenna structure 100. A curve S701 represents the radiation pattern of the antenna structure 100 at the zero degrees direction having the staggered centers of the radiating units 21 in the n array units 20 arranged along the Y axis. A curve S702 represents the radiation pattern of the antenna structure 100 at the zero degree direction having the centers of the radiating units 21 in the n array units 20 arranged in a line along the Y axis. As shown, the gain of the antenna structure 100 having the array unit 20 with the centers of the radiating units 21 in a line arranged along the Y axis is similar to the gain of the antenna structure 100 having the array unit 20 with the centers of the radiating units 21 in a line along the Y axis.

Figure 8:
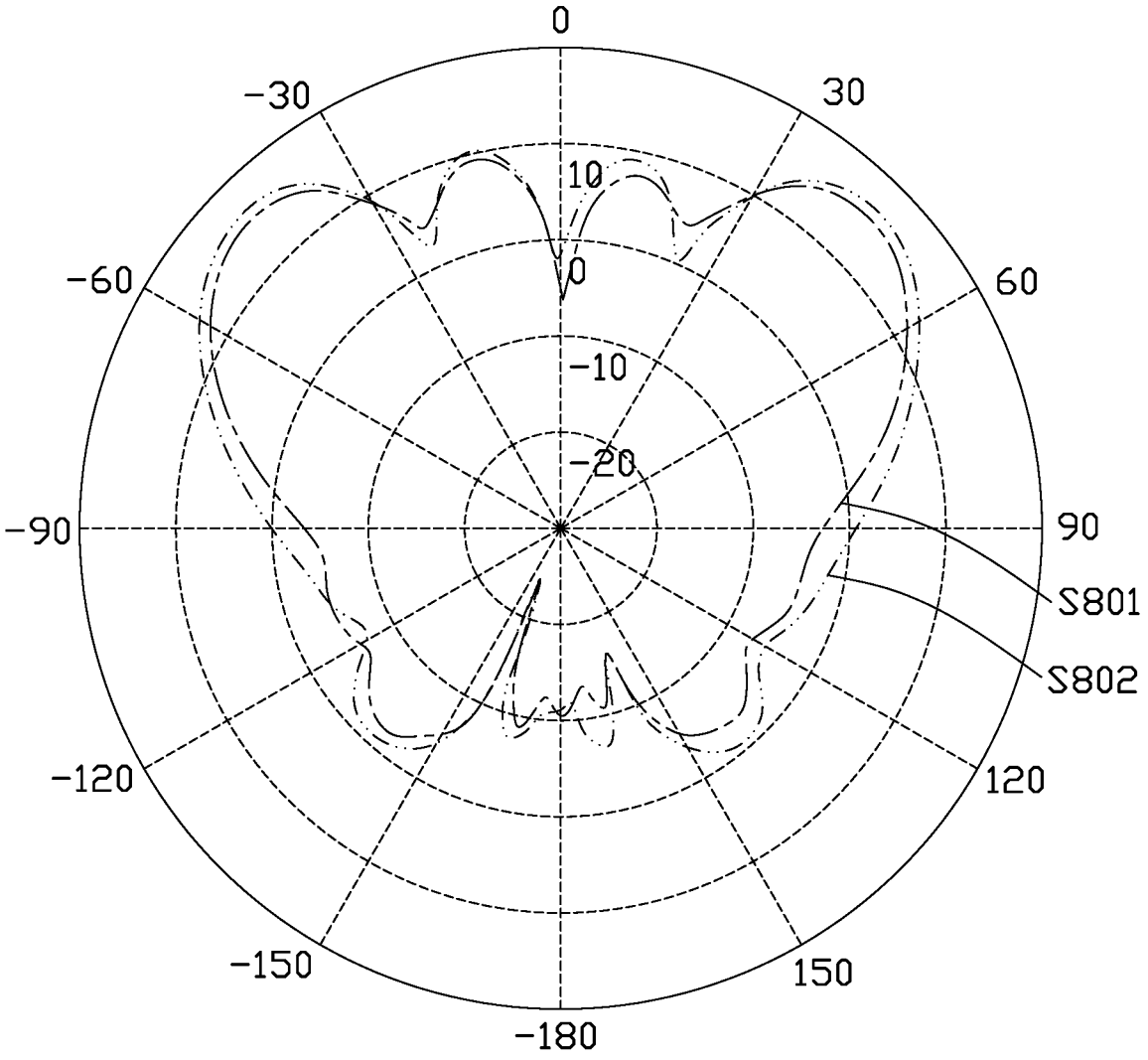
FIG. 8 shows waveform radiation patterns of the antenna structure of FIG. 3 at a leftmost direction and a rightmost direction.

FIG. 8 shows the radiation patterns of the antenna structure 100 at a leftmost direction and a rightmost direction. A curve S801 represents the radiation pattern of the antenna structure 100 at the leftmost direction and the rightmost direction having the staggered centers of the radiating units 21 in the n array units 20 along the Y axis. A curve S802 represents the radiation pattern of the antenna structure 100 at the leftmost direction and the rightmost direction having the centers of the radiating units 21 in the n array units 20 in a line along the Y axis. As shown, the gain of the antenna structure 100 having the array unit 20 with the centers of the radiating units 21 in a line along the Y axis is similar to the gain of the antenna structure 100 having the array unit 20 with the centers of the radiating units 21 in a line along the Y axis.

The antenna structure 100 comprises the centers of the radiating units 21, in the array units 20, with the staggered center along the Y axis, which have different areas. Thus, an isolation effect of the antenna structure 100 is improved, and the gain of the radiating element 20 is maintained.

Second Embodiment

Figure 9:
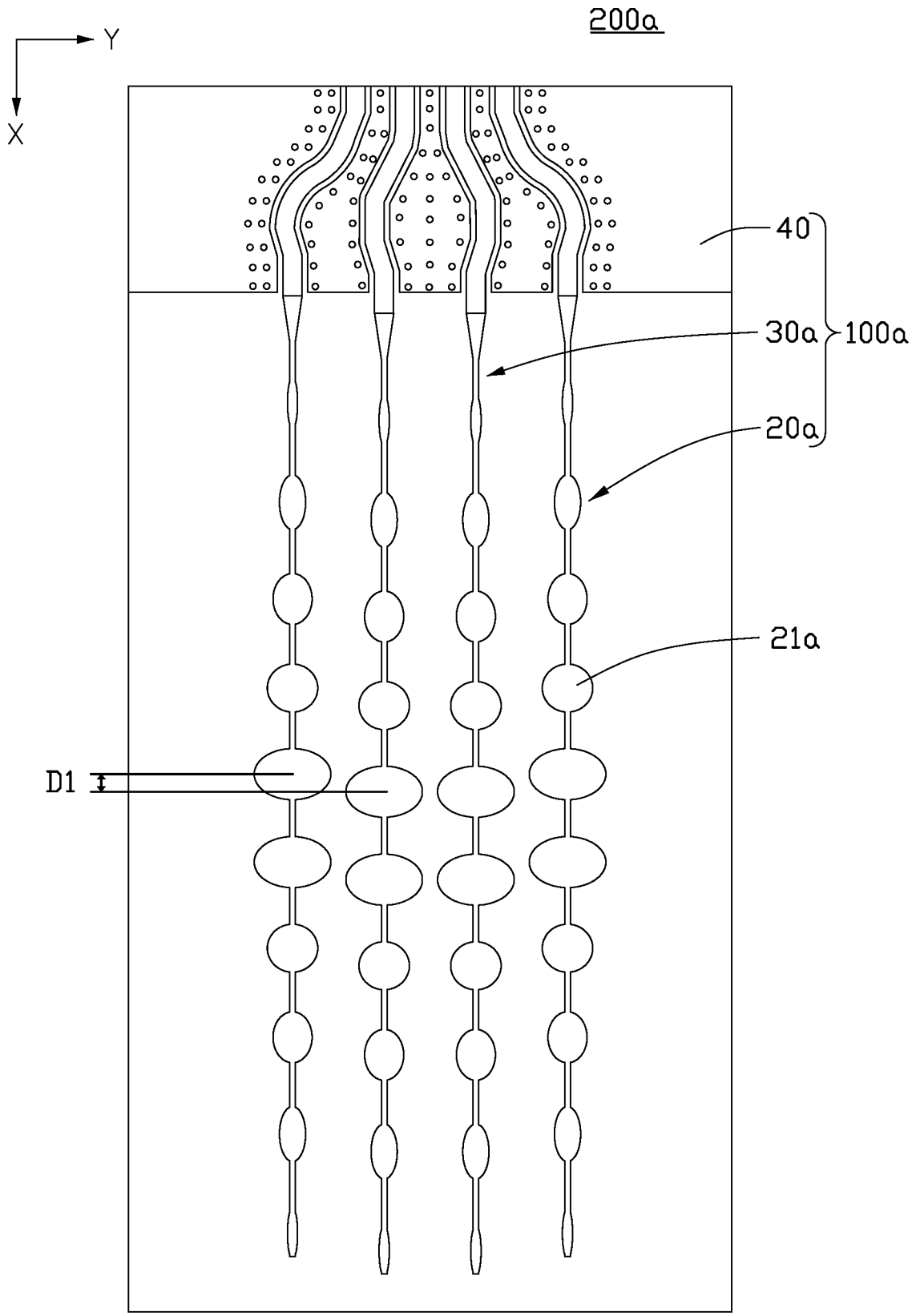
FIG. 9 is a diagram illustrating a second embodiment of the antenna structure in an electronic device.

FIG. 9 shows a second embodiment of the antenna structure 100*a* in an electronic device 200*a*. The antenna structure 100*a* includes an antenna array 30*a* and a co-planar waveguide 40.

The antenna array 30*a* includes n array units 20*a*. Each array unit 20*a* includes N radiating units 21*a*.

The difference between the antenna structure 100*a* and the antenna structure 100 is the symmetrical arrangement of the array units 20*a* along the Y axis. The array units 20*a* are divided into two groups arranged along the Y axis, the first array unit 20*a* on the left side and the fourth array unit 20*a* on the right side are symmetrically arranged. The second array unit 20*a* and the third array unit 20*a* are symmetrically arranged. The first array unit 20*a* and the second array unit 20*a* are not symmetrically arranged. The third array unit 20*a* and the fourth array unit 20*a* are not symmetrically arranged. Centers of the radiating units 21 in the symmetrical array units 20*a* are in a line along the Y axis. The centers of the radiating units 21 in the asymmetrical array unit 20*a* are staggered, and the distance D1 between the centers of the asymmetrical array units 20*a* along the X axis is in a range from 0.4 mm to 0.5 mm.

Third Embodiment

Figure 10:
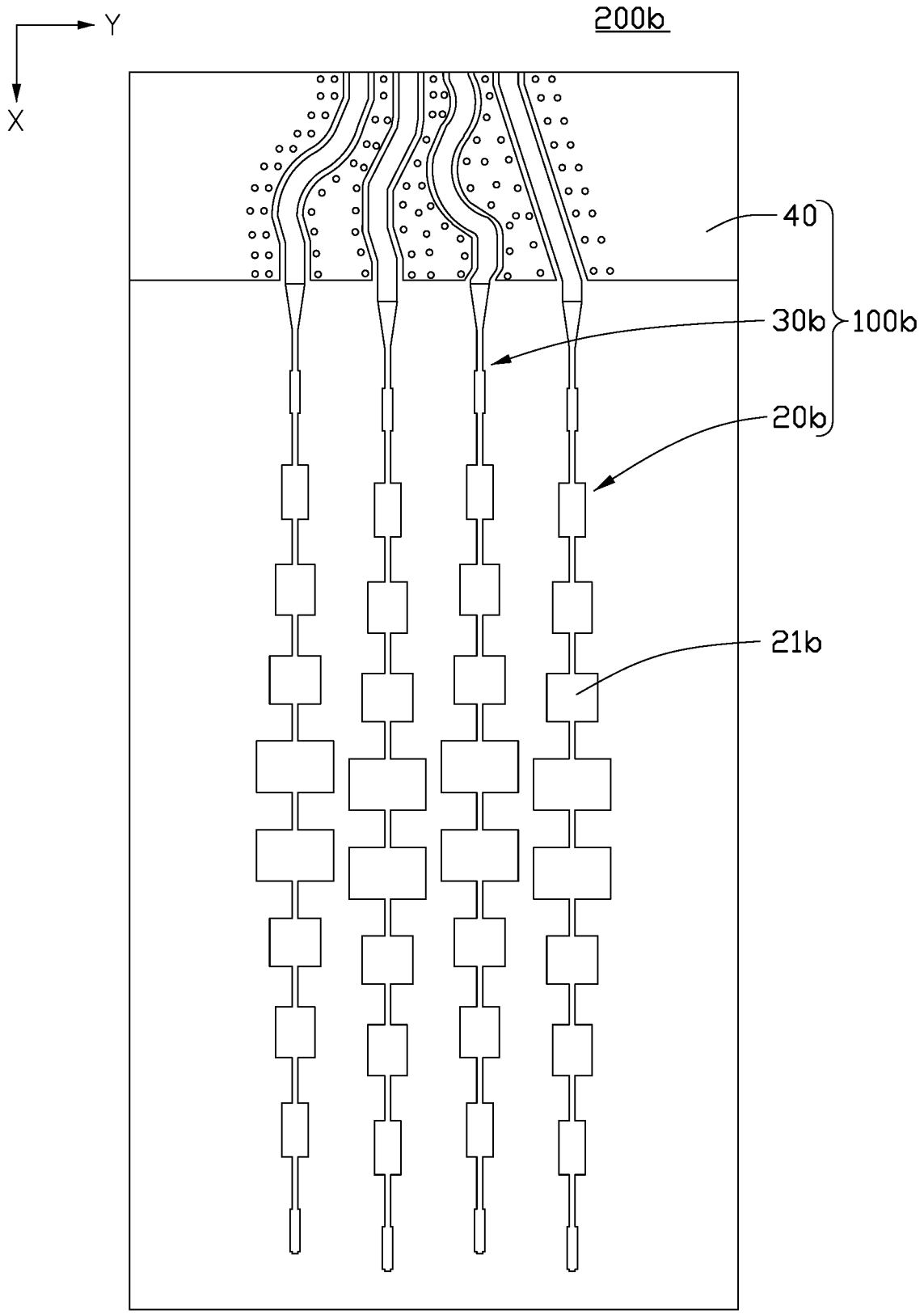
FIG. 10 is a diagram illustrating a third embodiment of the antenna structure in an electronic device.

FIG. 10 shows a third embodiment of the antenna structure 100*b* in an electronic device 200*b*. The antenna structure 100*a* includes an antenna array 30*b* and a co-planar waveguide 40.

The antenna array 30*b* includes n array units 20*b*. Each array unit 20*b* includes N radiating units 21*b*.

The difference between the antenna structure 100*b* and the antenna structure 100 is the shape of the radiating unit 21*b*. In one embodiment, the radiating unit 21*b* is a substantially rectangular shape. A length of the radiating unit 21*b* is parallel with the X axis, and a width of the radiating unit 21*b* is parallel with the Y axis. The length of each radiating unit 21*b* is not same as the width.

While various and preferred embodiments have been described the disclosure is not limited thereto. On the contrary, various modifications and similar arrangements (as would be apparent to those skilled in the art) are also intended to be covered. Therefore, the scope of the appended claims should be accorded the broadest interpretation so as to encompass all such modifications and similar arrangements.

What is claimed is:

1. An antenna structure of an electronic device, the antenna structure comprising:

an antenna array including an array unit, each array unit having a plurality of radiating units connected by a feeder; the feeder transmits a current signal to the array unit, and the radiating unit emits a radar beam based on the current signal;

wherein a radiation area of the radiating units gradually decrease from a center of the array unit to the ends of the array unit, and wherein the centers of adjacent radiating units along an extending direction of the feeder are spaced by a distance;

wherein the antenna structure further comprises a co-planar waveguide; the co-planar waveguide comprises a plurality of the feeders, a grounding layer, and a plurality of slots; the number of feeders is same as the number of array units; each side of a feeder defines one slot, and the slot separates the feeder from the grounding layer; the feeders, the slots, and the grounding layer are coplanar with each other.

2. The antenna structure of claim 1, wherein the radiating unit is substantially elliptical or rectangular shape; the distance of adjacent radiating units along an extending direction of the feeder is in a range from 0.4 mm to 0.5 mm.

3. The antenna structure of claim 1, wherein a distance between adjacent radiating units is λ; λ represents a wavelength of a current signal transmitting in the feeder of the antenna structure.

4. The antenna structure of claim 1, wherein a distance between adjacent array units is in a range from 0.5λ1 to 0.75λ1; λ1 represents a wavelength of a current signal from the antenna structure being transmitted in air.

5. The antenna structure of claim 1, wherein the feeders and the grounding layer are made of metal material.

6. The antenna structure of claim 5, wherein the antenna structure further comprises a grounding surface; the grounding surface is made of material, the grounding surface provides a ground voltage level to the antenna array.

7. The antenna structure of claim 6, wherein the antenna structure further comprises a plurality of through holes; the through holes surround the feeders and the slots; the through holes connect the grounding layer and the grounding surface.

8. An electronic device comprising:

a dielectric slab; and an antenna array including an array unit; each array unit having a plurality of radiating units connected by a feeder;

wherein a radiation area of the radiating units gradually decrease from a center of the array unit to the ends of the array unit, and wherein the centers of adjacent radiating units along an extending direction of the feeder are spaced by a distance;

the antenna structure further comprises a co-planar waveguide; the co-planar waveguide comprises a plurality of the feeders, a grounding layer, and a plurality of slots; the number of feeders is same as the number of array units; each side of a feeder defines one slot, and the slot separates the feeder from the grounding layer; the feeders, the slots, and the grounding layer are coplanar with each other.

9. The electronic device of claim 8, wherein the specified distance of the centers of adjacent radiating units along an extending direction of the feeder is in a range from 0.4 mm to 0.5 mm.

10. The electronic device of claim 8, wherein a distance between adjacent radiating units is λ; λ represents a wavelength of a current signal transmitting in the feeder of the antenna structure.

11. The electronic device of claim 8, wherein a distance between adjacent array units is in a range from 0.5λ1 to 0.75λ1; λ1 represents a wavelength of a current signal from the antenna structure being transmitted in air.

12. The electronic device of claim 8, wherein the feeders and the grounding layer are made of metal material.

13. The electronic device of claim 12, wherein the antenna structure further comprises a grounding surface; the grounding surface is made of material, the grounding surface provides a ground voltage level to the antenna array.

14. The electronic device of claim 13, wherein the antenna structure further comprises a plurality of through holes; the through holes surround the feeders and the slots; the through holes connect the grounding layer and the grounding surface.

15. The electronic device of claim 12, wherein the dielectric slab comprises a first surface and a second surface opposite to the first surface; the antenna array and the co-planar waveguide are disposed on the first surface, and the grounding surface is disposed on the second surface.

16. The electronic device of claim 8, wherein an end of the feeder is electrically connected with the corresponding array unit, and another end of the feeder is electrically connected to a feeding portion of the electronic device.

17. The electronic device of claim 8, wherein the array units are symmetrically arranged along the extending direction of the feeder; centers of the radiating units in the symmetrical array units are in a line along the Y axis; centers of the radiating units in the asymmetrical array units are spaced in the specified distance along the extending direction of the feeder.

18. The electronic device of claim 8, wherein each radiating unit is substantially elliptical shape.

19. The electronic device of claim 8, wherein each radiating unit is substantially rectangular shape.

* * * * *